United States Patent [19]

Berger

[11] Patent Number: 4,945,194

[45] Date of Patent: Jul. 31, 1990

[54] ELECTRIC MULTIPLE SWITCH ASSEMBLY WITH PUSHBUTTON ACTUATOR AND FORCE TRANSMITTING INSERT

[75] Inventor: Fritz Berger, Oberbuchsiten, Switzerland

[73] Assignee: Elektro-Apparatebau Olten AG, Olten, Switzerland

[21] Appl. No.: 301,611

[22] Filed: Jan. 24, 1989

[30] Foreign Application Priority Data

Feb. 1, 1988 [CH] Switzerland ..... 329/88-9

[51] Int. Cl.[5] ..... H01H 9/00; H01H 13/50

[52] U.S. Cl. ..... 200/5 R; 200/17 R

[58] Field of Search ..... 200/5 R, 17 R, 408–412, 200/415, 417, 422, 434, 435, 439, 447–450, 452, 467, 470–472, 520, 527, 529, 573

[56] References Cited

U.S. PATENT DOCUMENTS

| | | | |
|---|---|---|---|
| 3,816,681 | 6/1974 | Lunenschloss et al. | 200/409 |
| 3,867,598 | 2/1975 | Richards et al. | 200/449 |
| 4,086,455 | 4/1978 | Takahashi | 200/447 |
| 4,242,544 | 12/1980 | Schweitzer | 200/5 E |
| 4,242,545 | 12/1980 | Schweitzer | 200/5 R |
| 4,398,075 | 8/1983 | Vogel | 200/314 |
| 4,507,528 | 3/1985 | Vogel et al. | 200/302.2 |
| 4,766,306 | 8/1988 | Bichsel et al. | 250/227 |

FOREIGN PATENT DOCUMENTS 612791 8/1979 Switzerland .

*Primary Examiner*—J. R. Scott

*Attorney, Agent, or Firm*—Peter K. Kontler

[57] ABSTRACT

An electric pushbutton switch wherein the housing confines a reciprocable plunger which is coupled to and is movable by a pushbutton from an extended or inoperative to a depressed or operative position. The housing contains one or more pairs of fixed contacts and a mobile contact for each pair of fixed contacts. When the plunger is depressed, it simultaneously engages all mobile contacts with the respective pairs of fixed contacts through the medium of a ring-shaped insert which is floatingly installed in the housing between three or more spaced-apart legs of the plunger and discrete pushers, one for each mobile contact and each biased against the insert by a discrete spring acting upon a composite carrier for the respective mobile contact. Additional springs can react against the housing to bear against the insert with a force acting upon the insert within the polygon which is defined by the points of contact between the legs of the plunger and the insert. This also applies for the points of contact between the pushers and the insert.

15 Claims, 2 Drawing Sheets

ELECTRIC MULTIPLE SWITCH ASSEMBLY WITH PUSHBUTTON ACTUATOR AND FORCE TRANSMITTING INSERT

BACKGROUND OF THE INVENTION

The invention relates to electric switches in general, and more particularly to improvements in so-called pushbutton switches wherein a reciprocable plunger or an analogous mobile part is movable from an extended position to a depressed or operative position in which it completes one or more electric circuits. Electric pushbutton switches of such character can be used with advantage in control panels, distribution boards and like devices wherein a large number of switches must be mounted in one or more groups or arrays for convenient manipulation by an operator.

Electric pushbutton switches of the type to which the present invention pertains are disclosed, for example, in U.S. Pat. Nos. 4,242,544, 4,242,545, 4,398,075, 4,507,528 and 4,766,306, and in Swiss Pat. No. 612 791. An advantage of the electric pushbutton switch which is disclosed in the Swiss patent is that the terminals for various electric contacts are disposed in a plane extending at right angles to the direction of reciprocatory movement of the depressible plunger and are readily accessible after the switch is installed in the mounting plate of a control panel or the like. A drawback of the patented switch is that, if the plunger is to engage two or more mobile contacts with a corresponding number of fixed contacts, engagement or disengagement of all mobile contacts with or from the respective fixed contacts does not always take place at the same time, mainly due to manufacturing tolerances and/or as a result of wear upon the contacts and/or other parts of the switch.

OBJECTS OF THE INVENTION

An object of the invention is to provide a novel and improved electric pushbutton switch which is constructed and assembled in such a way that completion of two or more electric circuits can take place simultaneously in response to each depression of the movable switching member, such as a reciprocable plunger.

Another object of the invention is to provide a pushbutton switch which is less affected by wear upon its parts and/or by manufacturing tolerances than heretofore known pushbutton switches.

A further object of the invention is to provide the improved pushbutton switch with novel means for transmitting motion between the pushbutton and the mobile contact or contacts.

An additional object of the invention is to provide the pushbutton switch with novel and improved means for urging the pushbutton to its extended or inoperative position.

Still another object of the invention is to provide a novel and improved housing for use in the above outlined pushbutton switch.

An additional object of the invention is to provide a novel and improved method of ensuring simultaneous completion or interruption of two or more discrete electric circuits which are controlled by the above outlined pushbutton switch.

SUMMARY OF THE INVENTION

The invention is embodied in a pushbutton switch which comprises a housing having a first section and a second section, a plunger which is movable in the first section between an extended or inoperative and a depressed or operative position, switching means provided in the second section and including at least one first electric contact and at least one second electric contact, and means for engaging the second contact with the first contact in response to movement of the plunger to the depressed position. The engaging means comprises a floating insert which is disposed in the housing between the plunger and the second contact, a pusher between the second contact and the insert, means for biasing the pusher against the insert, and means for transmitting motion between the insert and the plunger at n spaced-apart points wherein n is a whole number exceeding two. The engaging means preferably further comprises a carrier for the second contact, and the aforementioned biasing means can include a spring which urges the carrier against the pusher. The aforementioned points are disposed at the corners of a polygon (e.g., a triangle, a square, a rectangle, a pentagon, etc.), and the pusher preferably acts upon the insert within the polygon. The motion transmitting means can comprise a plurality of projections which are provided on the plunger and each of which engages the insert at one of the aforementioned n points. Alternatively, the projections can be provided on the insert to engage the adjacent surface of the plunger.

The plunger can include or constitute a tube, and the insert can include a ring having a substantially diametrically extending reinforcing portion which is in line with and can be in direct contact with the pusher.

In accordance with a presently preferred embodiment, the switching means comprises a plurality of first contacts (e.g., three) and a second contact for each first contact. The engaging means then comprises a pusher for each second contact, and each pusher is in line with the reinforcing portion of the ring-shaped insert.

The switch can further include resilient means reacting against the housing and serving to urge the insert toward the plunger. Such resilient means can comprise a plurality of springs each of which is arranged to urge the insert against the motion transmitting means (provided that the motion transmitting means is rigid with the plunger). The resilient means is arranged to urge the insert against the plunger at one or more locations within the aforementioned polygon. It is preferred to mount the resilient means in such a way that its spring or springs act upon the reinforcing portion of the insert. The biasing means can comprise one or more first coil springs, and the resilient means can comprise one or more second coil springs.

Each carrier of the engaging means can include a first portion or arm which is fulcrumed in the second section of the housing, a second portion or arm which supports the respective second contact, and a hinge between the first and second portions. The aforementioned biasing means is arranged to urge the second portion or arm against the respective pusher.

The switch can further comprise a female centering element and a complementary male centering element which extends into the female centering element. One of these centering elements is provided on the insert and the other centering element is provided on the pusher. The biasing means is arranged to urge the plunger to the extended position by way of the pusher or pushers, insert and motion transmitting means.

The novel features which are considered as characteristic of the invention are set forth in particular in the appended claims. The improved switch itself, however, both as to its construction and the mode of assembling and operating the same, together with additional features and advantages thereof, will be best understood upon perusal of the following detailed description of certain specific embodiments with reference to the accompanying drawing.

DESCRIPTION OF PREFERRED EMBODIMENTS

Figure 1:
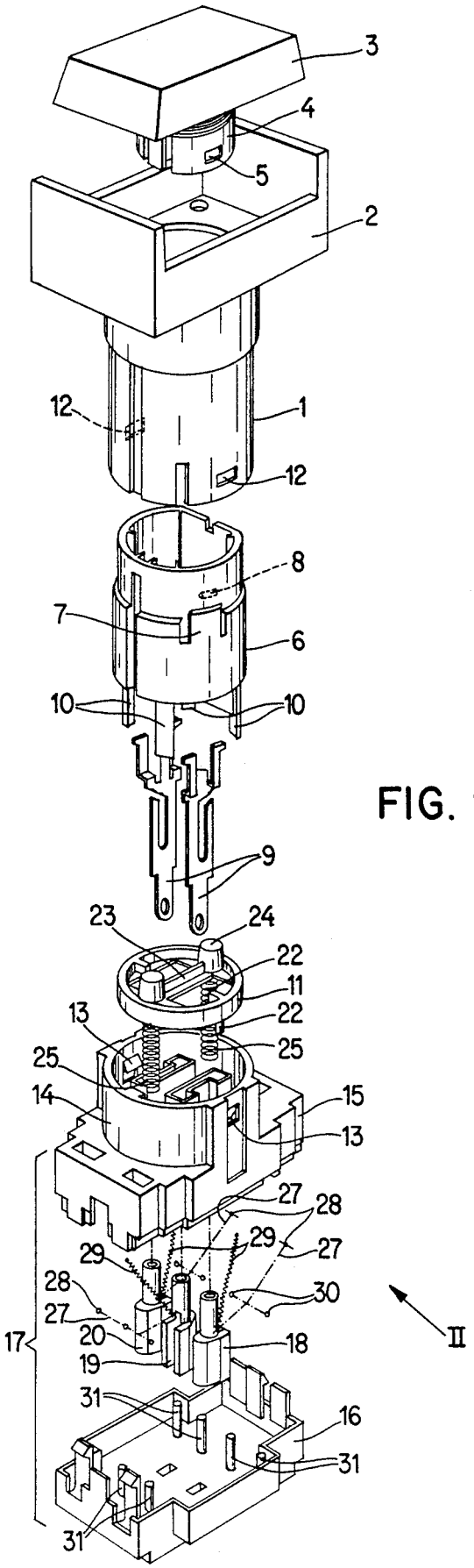
FIG. 1 is an exploded perspective view of an electric pushbutton switch which embodies one form of the invention.

Referring first to FIG. 1, there is shown an electric pushbutton switch which comprises a composite housing including a tubular first or front section 1 and a two-piece second or rear section 17. The forward end of the first section 1 carries a rectangular front frame 2 for a manually depressible light-transmitting pushbutton 3 carrying a light-transmitting cover (not shown) which is preferably made of a colored material. The pushbutton 3 has a neck portion 4 which is a tubular body with two detent notches 5 (only one shown) disposed diametrically opposite each other and serving to receive male detent elements 8 provided on a tubular plunger 6 which is reciprocable in the housing section 1 between an extended and a depressed position. The plunger 6 has a substantially cylindrical internal surface which surrounds, preferably without play, the cylindrical external surface of the neck portion 4 of pushbutton 3 when the male detent elements 8 are received in the respective detent notches 5. At such time, the pushbutton 3 can be said to constitute a separable part of the plunger 6 which latter is movable in the housing section 1 axially between the aforementioned extended (inoperative) and depressed (operative) positions. The plunger 6 has two or more stops 7 in the form of lugs which engage suitable shoulders (not shown) of the housing section 1 to arrest the plunger and the pushbutton 3 in their extended positions.

The switch of FIG. 1 is or can be provided with a light source (not shown) which is installed in the housing section 1 and is connectable with an energy source by way of two terminals 9 which are separably inserted into the housing section 17 and extend toward and into the housing section 1. The light source is removably installed in the housing section 1 and is caused to light up in response to movement of the pushbutton 3 and plunger 6 to their depressed positions.

The bottom end wall of the plunger 6 is provided with four axially parallel projections in the form of legs 10 each of which is maintained in contact with the adjacent side of a ring-shaped insert 11 which is floatingly inserted into the housing between the sections 1 and 17, preferably in a neck-shaped extension 14 of a first portion 15 of the section 17. The second portion 16 of the housing section 17 can be separably coupled to the portion 15 in a manner not forming part of the present invention but shown in the lower part of FIG. 1. Thus, the portion 16 has several flexible lugs which can snap into complementary recesses or sockets of the portion 15.

The number of legs 10 is not critical, as long as it exceeds two. The points of contact between the illustrated legs 10 and the respective side of the insert 11 are located at the four corners of a polygon to thus ensure that the insert 11 cannot be tilted relative to the plunger 6 when it is biased in a direction toward the front frame 2.

The housing section 1 has two sockets 12 for the protuberances 13 on the extension 14 of portion 15 of the housing section 17. The section 17 confines three reciprocable pushers 18, 19 and 20 which are installed in a line or row making an angle of 90° with a substantially diametrically extending rib-shaped reinforcing portion 23 of the ring-shaped insert 11. Each of the three pushers 18–20 includes a female centering portion 21 which is adjacent the insert 11 and has an axial hole or bore for a complementary male centering portion 22 (see particularly FIG. 2) of the reinforcing portion 23. The pushers 18–20 are aligned so that they can transmit pressure to the insert 11 in a plane which includes the reinforcing portion 23 and is within the polygon bounded by the points of contact between the insert 11 and the motion transmitting legs 10 of the plunger 6. The axis of the centrally located pusher 19 preferably coincides with the axis of the insert 11 and plunger 6. This even further reduces the likelihood of tilting of the insert 11 with reference to the plunger 6. The pushers 18 and 20 flank the centrally located pusher 19 and are located at the same distance therefrom.

The reinforcing portion 23 of the insert 11 has two cup-shaped receptacles 24 which are open toward the interior of the housing section 17 and receive the adjacent end convolutions of two resilient elements in the form of coil springs 25. The other end convolutions of the coil springs 25 surround centering studs 26 of the housing section 17 so that the springs 25 react against the housing and urge the insert 11 against the tips of the legs 11 on the plunger 6. This ensures that the plunger 6 and the pushbutton 3 reassume their extended positions as soon as the application of pressure against the pushbutton 3 is terminated or the depressing force is reduced sufficiently to enable the springs 25 to dissipate energy. The cupped receptacles 24 are adjacent the ends of the reinforcing portion 23.

The terminals 9 are inserted into the housing section 17 before the latter is coupled to the housing section 1. To this end, the portion 15 of the housing section 17 is provided with substantially U-shaped guides for the terminals 9. Such terminals are held in the respective guides by friction. The hook-shaped radially outwardly extending end portions of the terminals 9 overlie the respective side of the insert 11 and ensure that the insert 11 remains in the extension 14 while simultaneously maintaining the coil springs 25 in stressed condition so that the springs 25 urge the insert 11 against the legs 10 of the plunger 6. The coil springs 25 are also confined in the extension 14. When the housing section 1 is inserted into the extension 14 so that the male detent elements 13 can snap into the respective sockets 12, the tips of the legs 10 push the insert 11 deeper into the extension 14, i.e., away from the hook-shaped end portions of the terminals 9, whereby the insert 11 bears against the adjacent female centering portions 21 of the pushers 18–20 and each such female centering portion receives the respective male centering portion 22 of the reinforcing portion 23. This ensures that the coil springs 25 store sufficient energy in order to move the plunger 6 and the pushbutton 3 to their extended positions, and to thus interrupt the circuit including the terminals 9 for the light source in the housing, as soon as the pressure upon the pushbutton 3 is relaxed or terminated.

Figure 2:
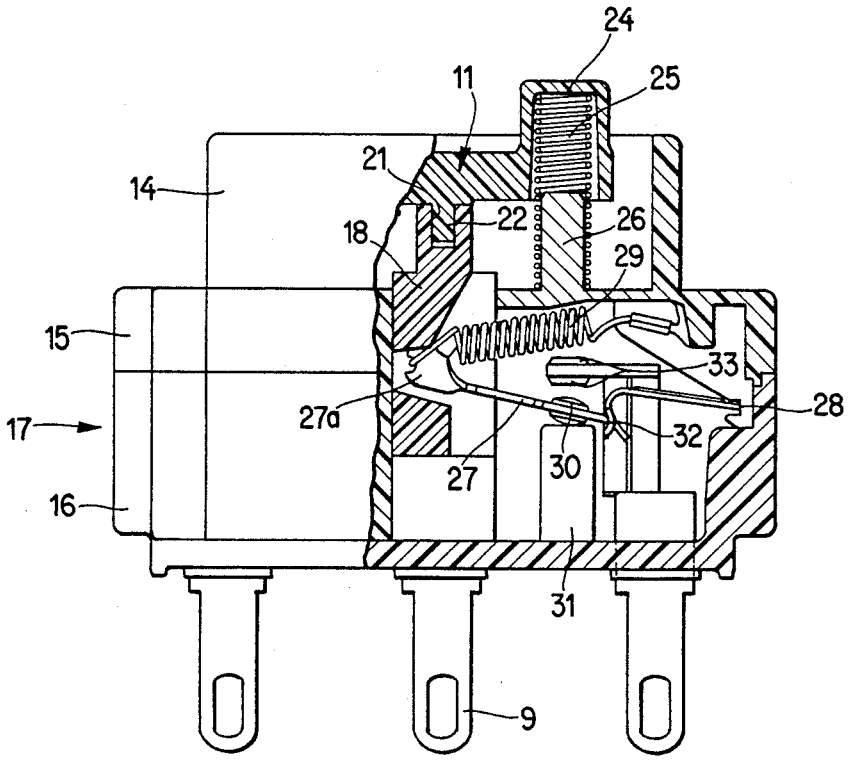
FIG. 2 is enlarged view of a detail, substantially as seen in the direction of arrow II in FIG. 1, with certain parts broken away.

The section 17 of the housing contains three carriers 27 for discrete movable contacts 30 (see particularly FIG. 2) each of which is caused to engage a pair of fixed contacts 33 in response to depression of the pushbutton 3. Each contact 27 includes a first portion which is fulcrumed in the portion 16 of housing section 17, as at 28; a second portion which carries the respective contact 30; and a hinge 32 which pivotably couples the two portions of each other. A biasing means in the form of a coil spring 29 is attached to the portion 15 of housing section 17 and engages the left-hand portion 27 *a* of the contact carrier 27 which is shown in FIG. 2 to urge such portion of the carrier 27 against the respective pusher 18 whereby the pusher 18 is urged against the respective side of the insert 11. The coil spring 29 tends to maintain the respective carrier 27 in the illustrated inoperative or inactive position in which the respective mobile contact 30 engages an abutment 31 on the portion 16 of housing section 17 and is spaced apart from the respective fixed contacts 33. The coil spring 29 cooperates with the coil springs 25 to urge the plunger 6 and the pushbutton 3 to their extended or inoperative positions.

The housing section 17 can confine one, two, three or more carriers 27 for movable contacts 30, and an equal number of pairs of fixedly mounted contacts 33, i.e., one pair of fixed contacts 33 for each movable contact 30. The number of pushers matches the number of contact carriers 27, i.e., the illustrated housing section 17 is assumed to contain three carriers 27. Irrespective of the number of carriers 27 and coil springs 29, the resultant of forces which are generated by the springs 29 and act upon the insert 11 is applied to the insert within the aforementioned polygon having its corners at the points of contact between the legs 10 of the plunger 6 and the insert. In other words, the transmission of aforementioned resultant force which is generated by the springs 29, as well as of the resultant of forces which are generated by the springs 25 is applied to the insert 11 in such a way that the latter invariably abuts all of the legs 10 and is thus maintained in an optimum position and orientation relative to the plunger 6. The just described selection of the loci of application of forces to the insert 11 by the springs 25 and/or 29 (the springs 25 are desirable and advantageous but optional) invariably ensures that the insert bears against the plunger 6 at more than two suitably distributed locations. This holds true even if the switch engaging means in the housing section 17 contains a single spring 25 and/or a single spring 29. The direction of action of the resultant force or forces is parallel to the axis of the plunger 6.

As can be seen in FIG. 2, the coil spring 29 engages the free end of the left-hand portion of the respective carrier 27 and thereby urges such free end against the adjacent end face of the pusher 18 while simultaneously urging the mobile contact 30 against the abutment 31. If the pusher 18 is caused to move downwardly (as seen in FIG. 2) in response to depression of the plunger 6 through the medium of the pushbutton 3, the left-hand portion of the carrier 27 is pivoted relative to the abutment 31 in a counterclockwise direction to and beyond a dead-center position whereupon the left-hand portion of the carrier 27 pivots relative to the right-hand portion about the axis of the hinge 32 so that the contact 30 is lifted off the abutment 31 and engages the adjacent fixed contacts 33 to thereby complete a circuit. The manner in which the fixed contacts 33 are connected with the poles of a suitable energy source (not shown) forms no part of the invention.

If the pressure upon the pushbutton 3 is thereupon relaxed or terminated, the spring 29 is free to dissipate energy and returns the contact 30 into engagement with the abutment 31 while simultaneously moving the pusher 18 upwardly (as seen in FIG. 2) so that the plunger 6 and the pushbutton 3 are returned to their extended positions. The left-hand portion of the carrier 29 which is shown in FIG. 2 moves back toward its dead-center position and thereupon snaps over by pivoting at 32 to reassume the position which is shown in FIG. 2 while the coil spring 29 dissipates energy.

It is assumed here that the illustrated switch is a so-called momentary switch wherein the pushbutton 3 automatically reassumes the extended position when the pressure upon its exposed surface is relaxed or terminated. If the switch is a so-called latching or alternate-action switch, a first depression of the pushbutton 3 results in retention of the plunger 6 in depressed position. It is then necessary to depress the pushbutton 3 for a second time in order to initiate a movement of the plunger 6 back to the extended position.

An important advantage of the improved pushbutton switch is that the floating insert 11 cooperates with the pushers 18–20 and with the legs 10 of the plunger 6 to ensure simultaneous completion of circuits including the movable contacts 30 and the respective pairs of fixed contacts 33, irrespective of eventual manufacturing tolerances and irrespective of eventual wear on the component parts of the switch.

The coil springs 25 ensure that the insert 11 is invariably biased with a force (namely with the resultant of forces generated by the springs 29 and with the resultant of forces generated by the springs 25) which suffices to ensure predictable return movement of the plunger 6 to its extended position. Moreover, all forces are transmitted to the insert 11 in the plane of the reinforcing portion 23 and the insert, in turn, transmits to the plunger 6 all forces in a plane which includes and is bounded by the points of contact between the ring-shaped portion of the insert and the tips of the legs 10. The number of coil springs 25 is not dependent upon the number of pushers and can be inversely proportional thereto. The force with which the insert 11 bears upon the legs 10 of the plunger 6 is or can be substantially constant, i.e., the overall number of springs 25, 29 need not be changed proportionally with the number of pushers.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A pushbutton switch comprising a housing having a first section and a second section; a plunger movable in said first section between extended and depressed positions; switching means provided in said second section and including at least one first contact and at least one second contact; and means for engaging said second contact with said first contact in response to movement of said plunger to said depressed position, including a floating insert disposed in said housing between said plunger and said second contact, a pusher between said second contact and said insert, means for biasing said pusher against said insert, and means for transmitting motion between said insert and said plunger at n points wherein n is a whole number exceeding two.

2. The switch of claim 1, wherein said engaging means further comprises a carrier for said at least one second contact, said biasing means including means for urging said carrier against said pusher.

3. The switch of claim 1, wherein said points are disposed at the corners of a polygon and said pusher acts upon said insert within said polygon.

4. The switch of claim 3, wherein said motion transmitting means comprises a plurality of projections provided on said plunger and each said projection engaging said insert at one of said points.

5. The switch of claim 4, wherein at least a portion of said plunger has a tubular configuration.

6. The switch of claim 3, wherein said insert includes a ring having a substantially diametrically extending reinforcing portion, said pusher being in line with said reinforcing portion.

7. The switch of claim 6, wherein said switching means includes a plurality of first contacts and a second contact for each of said plurality of first contacts, said engaging means including a pusher for each of said second contacts.

8. The switch of claim 3, further comprising resilient means reacting against the second section of said housing and arranged to urge said insert toward said plunger.

9. The switch of claim 8, wherein said resilient means includes a plurality of springs each arranged to urge said insert against said motion transmitting means.

10. The switch of claim 8, wherein said resilient means is arranged to urge said insert toward said plunger within said polygon.

11. The switch of claim 8, wherein said insert includes a ring having a substantially diametrically extending reinforcing portion, said resilient means being arranged to act upon said reinforcing portion.

12. The switch of claim 11, wherein said biasing means comprises at least one first coil spring and said resilient means comprises at least one second coil spring.

13. The switch of claim 1, wherein said engaging means further comprises a carrier for said second contact, said carrier having a first portion fulcrumed in said housing, a second portion supporting said second contact, and a hinge between said first and second portions, said biasing means having means for urging the second portion of said carrier against said pusher.

14. The switch of claim 1, further comprising a female centering element and a complementary male centering element extending into said female element, one of said centering elements being provided on said insert and the other of said centering elements being provided on said pusher.

15. The switch of claim 1, wherein said biasing means is arranged to urge said plunger to said extended position by way of said pusher, said insert and said motion transmitting means.

* * * * *